US008690361B2

(12) United States Patent
Wang et al.

(10) Patent No.: US 8,690,361 B2
(45) Date of Patent: Apr. 8, 2014

(54) CASE STRUCTURE AND OPTICAL DEVICE HAVING SUCH CASE STRUCTURE

(75) Inventors: Tien-Hsiung Wang, Taoyuan Hsien (TW); Tsang-Hsing Ku, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 527 days.

(21) Appl. No.: 12/982,780

(22) Filed: Dec. 30, 2010

(65) Prior Publication Data

US 2011/0168589 A1 Jul. 14, 2011

(30) Foreign Application Priority Data

Jan. 11, 2010 (TW) ..... 99100619 A

(51) Int. Cl.
*G03B 21/14* (2006.01)

(52) U.S. Cl.
USPC ..... 353/119; 353/74; 353/79; 353/94; 353/99; 206/316.1; 312/10.1

(58) Field of Classification Search
USPC ..... 353/74, 79, 94, 98, 99, 119; 348/383, 348/787, 836, 843, E5.144; 349/5, 7–9; 312/10.1, 7.2; 333/74, 79, 94, 98, 99, 333/119; 206/316.1
See application file for complete search history.

(56) References Cited

U.S. PATENT DOCUMENTS

| | | | | |
|---|---|---|---|---|
| 6,811,265 | B2 * | 11/2004 | Soper et al. | 353/99 |
| 6,844,979 | B2 * | 1/2005 | Maki et al. | 359/629 |
| 7,246,908 | B2 * | 7/2007 | Salvatori et al. | 353/69 |
| 7,950,810 | B2 * | 5/2011 | Liao et al. | 353/101 |
| 2003/0030775 | A1 * | 2/2003 | Wagner et al. | 353/30 |
| 2004/0119952 | A1 * | 6/2004 | Chen | 353/119 |
| 2005/0254020 | A1 * | 11/2005 | Kim et al. | 353/98 |
| 2008/0218037 | A1 * | 9/2008 | Adachi et al. | 312/10.1 |

FOREIGN PATENT DOCUMENTS

| | | | |
|---|---|---|---|
| CN | 2595127 | Y | 12/2003 |
| CN | 1501667 | A | 6/2004 |
| CN | 1877440 | A | 12/2006 |
| CN | 101026231 | A | 8/2007 |
| CN | 201001240 | Y | 1/2008 |
| TW | I285525 | B | 8/2007 |

* cited by examiner

*Primary Examiner* — Georgia Epps
*Assistant Examiner* — Sultan Chowdhury

(57) ABSTRACT

A case structure includes a covering member and a lid member. The covering member includes a main boy, a first coupling part and a first positioning part. The lid member includes a lid plate, a second coupling part and a second positioning part. The second coupling part of the lid member and the first coupling part of the covering member are engaged with each other so that the lid plate is coupled with the main body and pivotal with respect to the main body. When the lid plate is rotated to a first position, the second positioning part is interference-fitted into the first positioning part so that the lid plate is positioned with respect to the main body.

20 Claims, 9 Drawing Sheets

CASE STRUCTURE AND OPTICAL DEVICE HAVING SUCH CASE STRUCTURE

CLAIM OF PRIORITY

This application claims priority to Taiwanese Patent Application No. 099100619 filed on Jan. 11, 2010.

FIELD OF THE INVENTION

The present invention relates to a case structure, and more particularly to a case structure for use with an optical device.

BACKGROUND OF THE INVENTION

Generally, a case structure of an optical device has a lid. After the lid is opened, the user may perform a maintenance process of replacing a lamp, adjusting the component or adjusting the focal length of the optical device.

Take a projector for example. The lid of the case structure is usually a discrete component. By means of a fastening element (e.g. a screw), the lid is fixed on a covering member of the case structure. For opening the lid, the screw needs to be removed by a screwdriver. As known, the screw is possibly lost after the screw is removed. In addition, if the user forgets to place the lid on the covering member, the foreign matter (e.g. dust, moisture, or the like) may enter the internal portion of the projector to adversely affect the projector.

For solving the above problems, a case structure having a pivotal lid is developed. This case structure, however, still has some drawbacks. For example, the lid fails to be properly fixed in a specified position after the lid is opened. While the maintenance process is performed by one hand of the user, the lid needs to be held by the other hand of the user. That is, the maintenance process of the optical device is not user-friendly. In addition, if the lid is closed during the maintenance process of the optical device, the user's hand is readily hurt by the lid. In a case that the projector is hung on a wall or a ceiling, the above problem becomes more serious.

Therefore, there is a need of providing a case structure for use with an optical device so as to obviate the drawbacks encountered from the prior art.

SUMMARY OF THE INVENTION

It is an object of the present invention to provide a case structure for facilitating the user to perform the maintenance process of the optical device in a user-friendly and safe manner.

In accordance with an aspect of the present invention, there is provided a case structure. The case structure includes a covering member and a lid member. The covering member includes a main boy, a first coupling part and a first positioning part. The lid member includes a lid plate, a second coupling part and a second positioning part. The second coupling part of the lid member and the first coupling part of the covering member are engaged with each other, so that the lid plate is coupled with the main body and pivotal with respect to the main body. When the lid plate is rotated to a first position, the second positioning part is interference-fitted into the first positioning part, so that the lid plate is positioned with respect to the main body.

In accordance with another aspect of the present invention, there is provided an optical device. The optical device includes an optical engine and a case structure. The case structure is used for partially shielding the optical engine. The case structure includes a covering member and a lid member.

The covering member includes a main boy, a first coupling part and a first positioning part. The lid member includes a lid plate, a second coupling part and a second positioning part. The second coupling part of the lid member and the first coupling part of the covering member are engaged with each other, so that the lid plate is coupled with the main body and pivotal with respect to the main body. When the lid plate is rotated to a first position, the second positioning part is interference-fitted into the first positioning part, so that the lid plate is positioned with respect to the main body.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
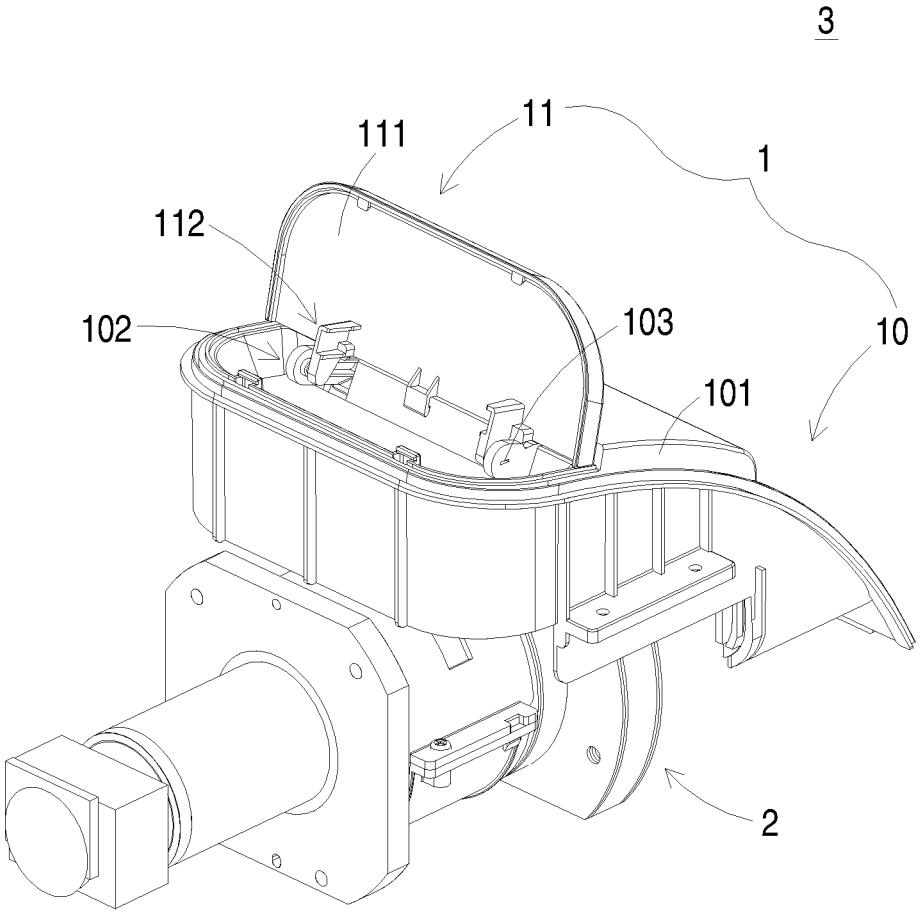
FIG. 1 is a schematic perspective view illustrating a case structure of an optical device according to an embodiment of the present invention.

FIG. 1 is a schematic perspective view illustrating a case structure of an optical device according to an embodiment of the present invention. As shown in FIG. 1, the case structure 1 is applied to an optical device 3. An example of the optical device 3 is a projector. In addition to the case structure 1, the optical device 3 further comprises an optical engine 2. In this embodiment, the optical engine 2 is partially shielded by the case structure 1. The case structure 1 comprises a covering member 10 and a lid member 11. The covering member 10 comprises a main body 101, a first coupling part 102 and a first positioning part 103. The lid member 11 comprises a lid plate 111, a second coupling part 112 and a second positioning part 113 (see FIG. 2A). The second coupling part 112 of the lid member 11 and the first coupling part 102 of the covering member 10 are engaged with each other, so that the lid plate 111 is coupled with the main body 101 of the covering member 10 and pivotal with respect to the main body 101. When the lid plate 111 is rotated to a first position, the second positioning part 113 is interference-fitted into the first positioning part 103 so that the lid plate 111 is positioned with respect to the main body 101.

Figure 2A:
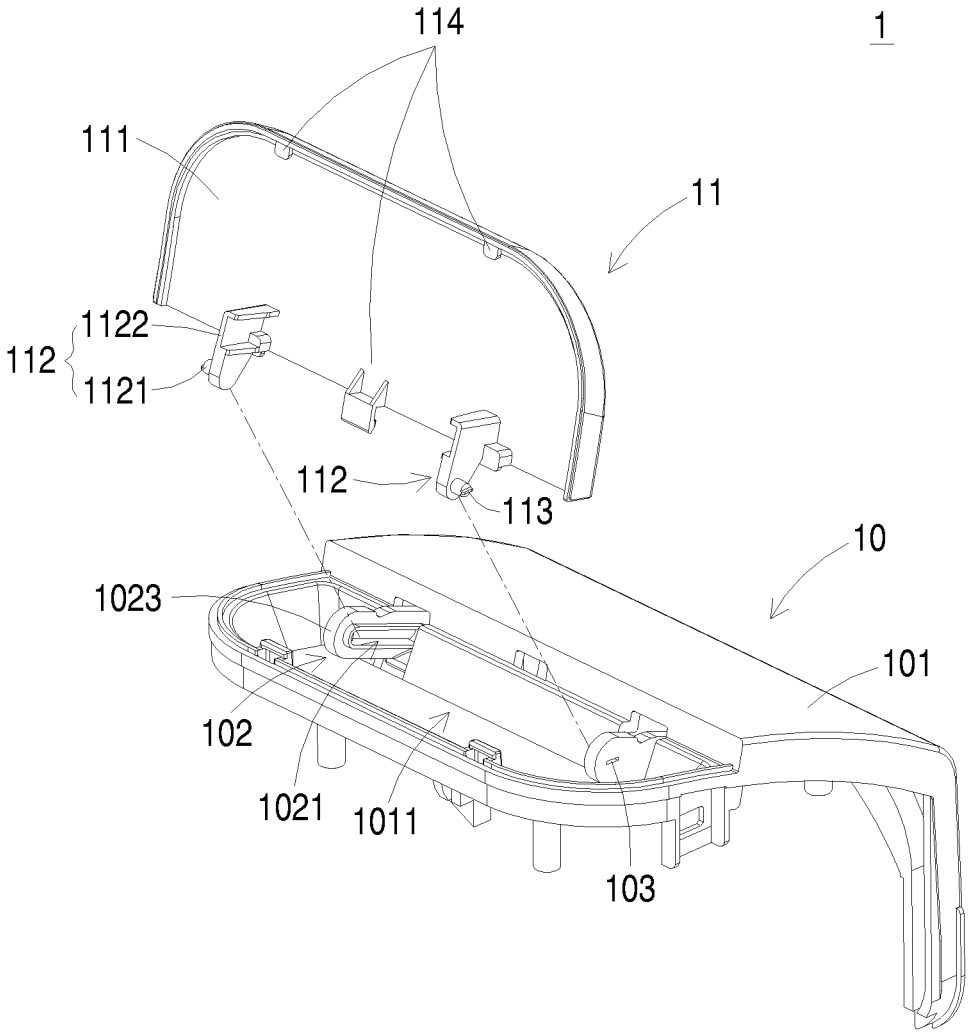
FIGS. 2A and 2B are schematic exploded views illustrating a portion of the case structure shown in FIG. 1.
Figure 2B:
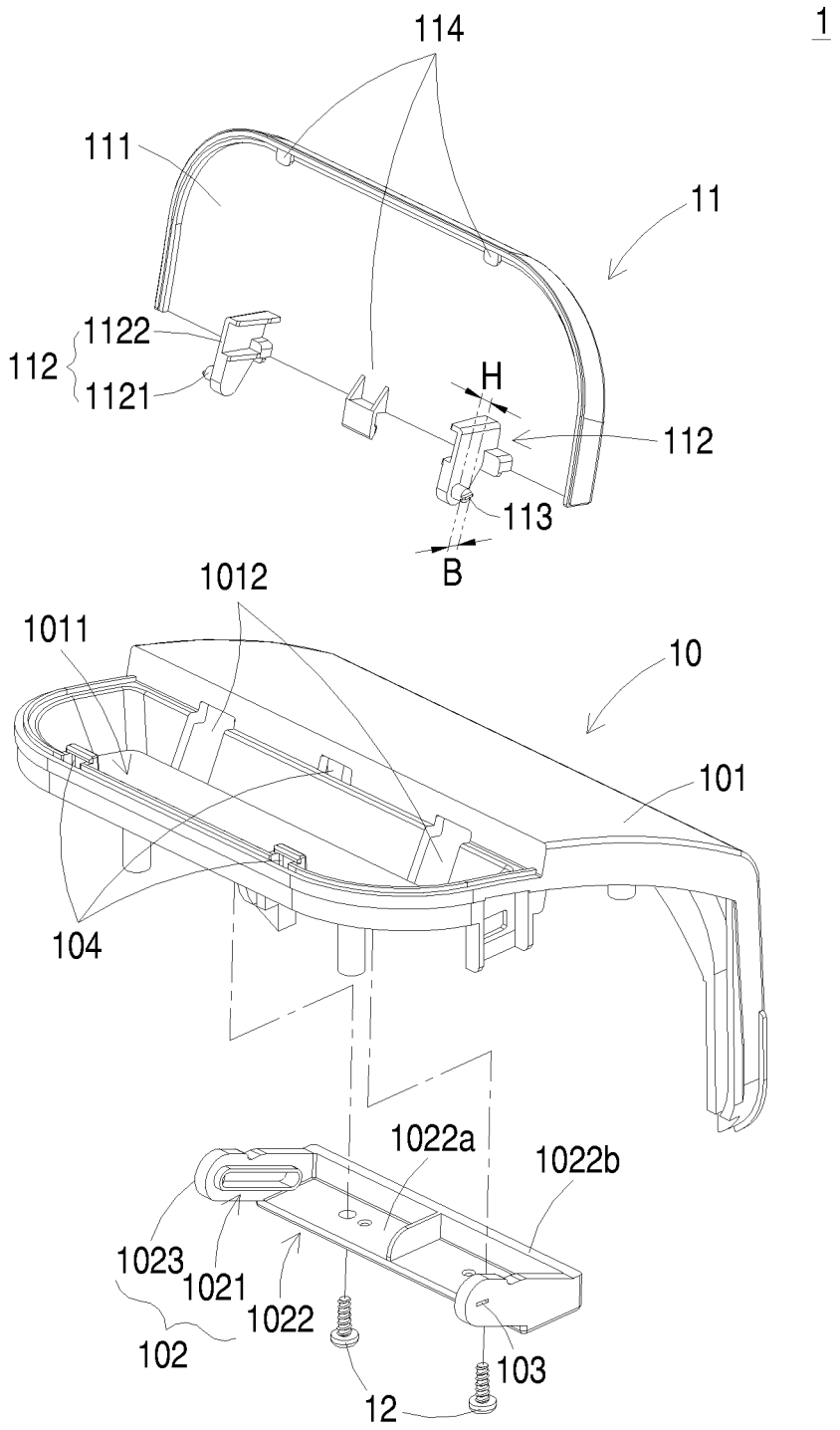

FIGS. 2A and 2B are schematic exploded views illustrating a portion of the case structure shown in FIG. 1. For clarification, some components of the covering member 10 are not shown in the drawings. As shown in FIGS. 2A and 2B, the covering member 10 of the case structure 1 comprises a main body 101, a first coupling part 102 and a first positioning part 103. The main body 101 comprises an operating space 1011 and at least one perforation 1012. The operating space 1011 is substantially a hollow portion. In a case that the lid plate 111 is opened to expose the operating space 1011, the user may perform a maintenance process of replacing the lamp of the optical engine 2, adjusting the component of the optical engine 2 or adjusting the focal length of the optical engine 2. The perforation 1012 runs through the main body 101 and is in communication with the operating space 1011. In this embodiment, the main body 101 has two perforations 1012. These perforations 1012 are formed in the same sidewall of the operating space 1011. In addition, the covering member 10 comprises at least one third positioning part 104, which is formed in the periphery (e.g. an upper periphery) of the operating space 1011. In this embodiment, the covering member 10 comprises three third positioning parts 104, which are fastening slots. In this embodiment, one of the fastening slots is arranged between the two perforations 1012. The other two fastening slots are arranged on the opposite side of the perforations 1012. The positions, numbers or profiles of the fastening slots of the first positioning part 103 are not restricted.

Figure 2C:
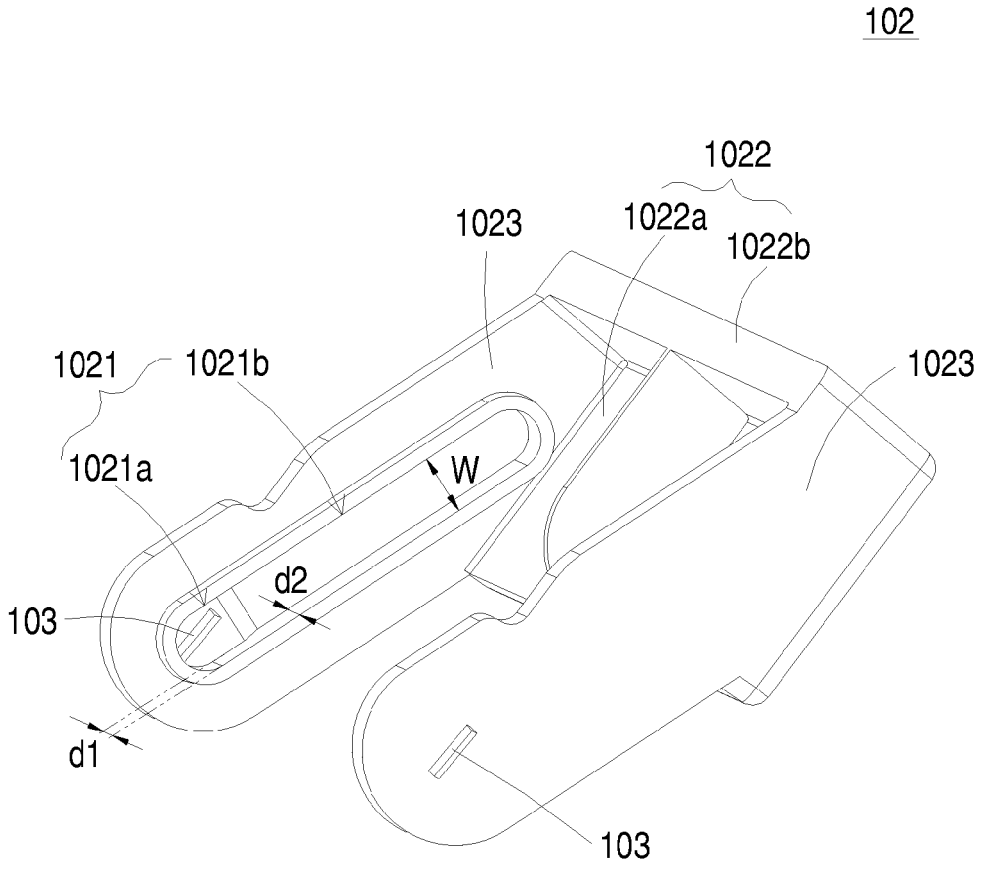
FIG. 2C is a schematic perspective view illustrating the first coupling part as shown in FIG. 2B.

FIG. 2C is a schematic perspective view illustrating the first coupling part as shown in FIG. 2B. The first coupling part 102 of the covering member 10 is detachably coupled with the main body 101. In this embodiment, the first coupling part 102 comprises at least one guiding track 1021, a connecting element 1022 and at least one first extension element 1023. The connecting element 1022 comprises a base plate 1022*a* and a side plate 1022*b*. The side plate 1022*b* is substantially perpendicular to the base plate 1022*a* so that the connecting element 1022 is L-shaped. In this embodiment, the first coupling part 102 has two first extension elements 1023. These two first extension elements 1023 are arranged at two opposite terminals of the connecting element 1022. The two first extension elements 1023 are slightly inclined with respect to the base plate 1022*a*. In other words, the two first extension elements 1023 are aslant extended from two opposite terminals of the connecting element 1022. In this embodiment, the first coupling part 102 has two guiding tracks 1021. The guiding tracks 1021 are disposed in respective first extension elements 1023, and face the connecting element 1022. The guiding tracks 1021 are symmetrical with respect to the centerline of the connecting element 1022.

Please refer to FIG. 2C again. The guiding track 1021 of the first coupling part 102 comprises a first segment 1021*a* and a second segment 1021*b*. The second segment 1021*b* is longer than the first segment 1021*a*. The depth d2 of the second segment 1021*b* is slightly greater than the depth d1 of the first segment 1021*a*. In other words, the first segment 1021*a* is slightly raised with respect to the second segment 1021*b*. The first segment 1021*a* and the second segment 1021*b* have the same width W. In this embodiment, the first segment 1021*a* of the guiding track 1021 is aslant extended from the connecting element 1022, the guiding track 1021 is disposed in the first extension element 1023, and the second segment 1021*b* is closer to the connecting element 1022 than the first segment 1021*a*. In other words, the guiding track 1021 is inclined with respect to the base plate 1022*a* of the connecting element 1022 so as to form an inclined track. The first segment 1021*a* is higher than the second segment 1021*b*. The first positioning part 103 of the covering member 10 is a fastening slot (e.g. a linear slot), which runs through the first extension element 1023. In this embodiment, the covering member 10 comprises two first positioning parts 103. These two first positioning parts 103 are disposed in the first segments 1021*a* of respective guiding tracks 1021. It is preferred that the guiding tracks 1021, the connecting element 1022 and the first extension elements 1023 of the first coupling part 102 are integrally formed. For example, the first coupling part 102 is produced by a plastic injection molding process.

Please refer to FIGS. 2A and 2B again. By means of a fixing element 12 (e.g. a screw), the first coupling part 102 is fixed on the main body 101. Especially, the substrate 1022*a* of the connecting element 1022 of the first coupling part 102 is fixed on the main body 101 and in the vicinity of the operating space 1011 by means of the fixing element 12. The first extension elements 1023 are protruded into the operating space 1011 through the perforations 1012 of the main body 101 (see FIG. 2A). Since the guiding tracks 1021 are disposed in the first extension elements 1023, the guiding tracks 1021 are also protruded into the operating space 1011.

Please refer to FIGS. 2A and 2B again. The lid member 11 comprises the lid plate 111, the second coupling part 112 and the second positioning part 113. The profile and dimension of the lid plate 111 mate with the upper edge of the operating space 1011. As such, when the lid plate 111 is closed with respect to the main body 101 and moved to the coupling position, the operating space 1011 is sealed by the lid plate 111 (see FIG. 3C).

The second coupling part 112 of the lid member 11 comprises a protruding block 1121 and a second extension element 1122. The second extension element 1122 is disposed on a surface of the lid plate 111 and extended from an edge of the lid plate 111. The location of the second extension element 1122 corresponds to the first extension element 1023 of the first coupling part 102. It is preferred that the second extension element 1122 is made of flexible and deformable material. The protruding block 1121 is disposed on the second extension element 1122 and arranged in the vicinity of the distal end of the second extension element 1122. In this embodiment, the protruding block 1121 is a cylindrical rod perpendicular to the second extension element 1122. The height H of the protruding block 1121 is slightly greater than or equal to the depth d1 of the first segment 1021*a* of the guiding track 1021 of the first coupling part 102. The protruding block 1121 has a width B, which is a diameter of the cylindrical rod. The width B of the protruding block 1121 is substantially equal to the width W of the guiding track 1021. After the lid member 11 is combined with the covering member 10, the protruding block 1121 is accommodated within the guiding track 1021 and movable within the guiding track 1021. The second positioning part 113 of the lid member 11 is disposed on the protruding block 1121. The dimension and shape of the second positioning part 113 mate with the first positioning part 103 of the covering member 10. The first positioning part 103 of the covering member 10 is a linear slot. In other words, the second positioning part 113 of the lid member 11 is a linear protrusion.

In addition to the lid plate 111, the second coupling part 112 and the second positioning part 113, the lid member 11 further comprises at least one fourth positioning part 114. The fourth positioning part 114 is disposed on the lid plate 111. The positions, numbers or profiles of the fourth positioning part 114 correspond to those of the third positioning part 104 of the covering member 10. In this embodiment, the lid member 11 has three fourth positioning parts 114. One of the fourth positioning parts 114 is arranged between the two second coupling parts 112. The other two fourth positioning parts 114 are arranged on opposite sides of the two second coupling parts 112. In this embodiment, the fourth positioning parts 114 are hooking elements, which are engaged with the fastening slots (i.e. the third positioning parts 104). In this embodiment, the lid plate 111, the second coupling part 112, the second positioning part 113 and the fourth positioning part 114 are integrally formed. For example, the lid member 11 is produced by a plastic injection molding process.

Please refer to FIGS. 1 and 2A again. For combining the lid member 11 with the covering member 10 to assemble the case structure 1, the second extension element 1122 of the second coupling part 112 is aligned with the first extension element 1023 of the first coupling part 102, and then the protruding block 1121 of the second extension element 1122 is accommodated within the guiding track 1021 of the first extension element 1023. As such, the lid plate 111 is coupled with the main body 101 (see FIG. 1). Due to engagement between the guiding track 1021 and the protruding block 1121, the lid member 11 is securely fixed on the covering member 10. The higher H of the protruding block 1121 is slightly greater than or equal to the depth d1 of the first segment 1121*a* but smaller than the depth d2 of the second segment 1121*b*. In addition, the width B of the protruding block 1121 is substantially equal to the width W of the guiding track 1021. By switching the lid plate 111 of the lid member 11 between the first position and the second position, the protruding block 1121 of the second coupling part 112 is movable along guiding track 1021 and rotatable with respect to the main body 101.

Figure 3A:
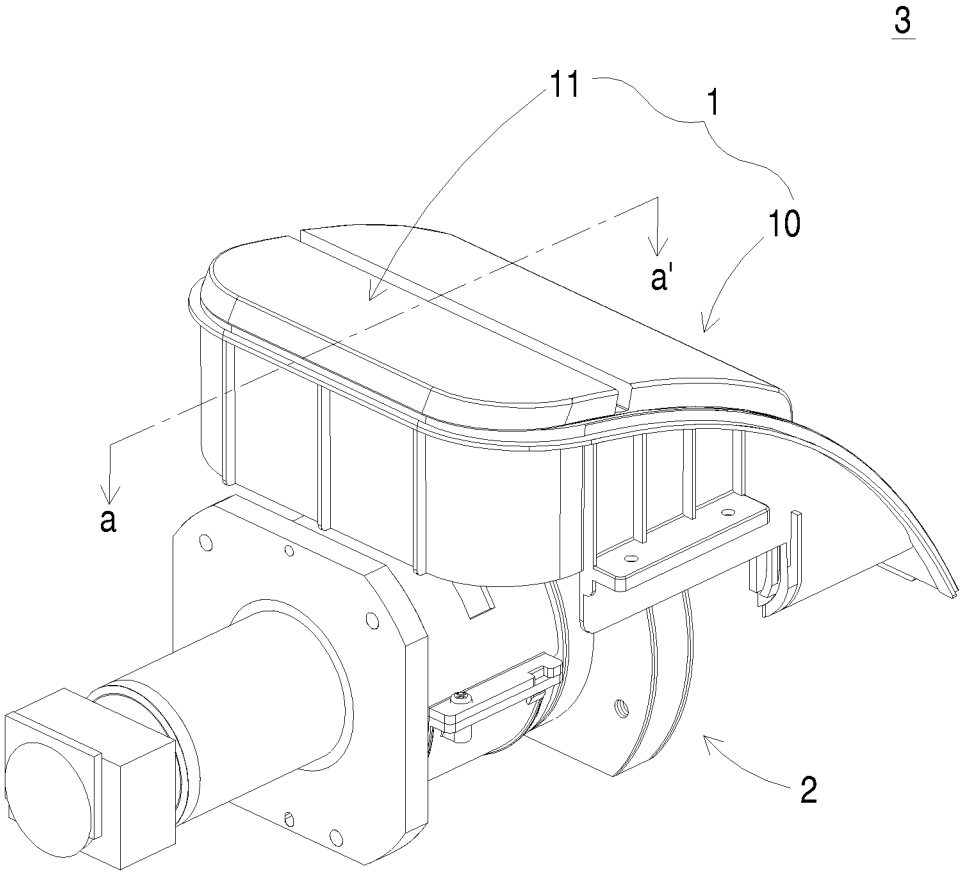
FIG. 3A is a schematic perspective view illustrating the case structure of FIG. 1, in which the lid member is closed with respect to the covering member.
Figure 3B:
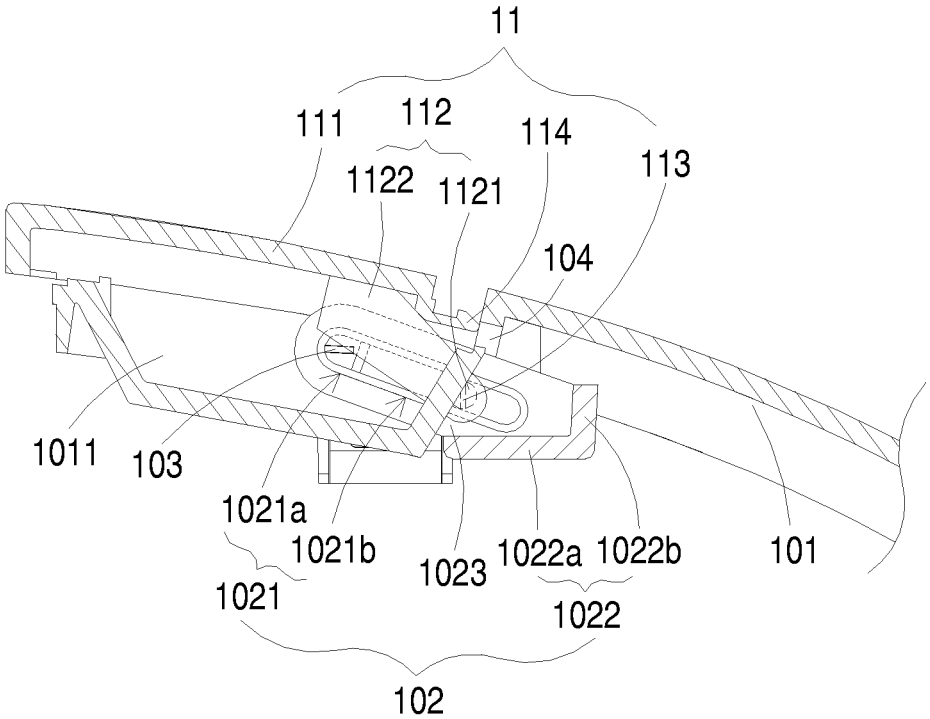
FIG. 3B is a schematic cross-sectional view illustrating the case structure of FIG. 3A and taken along the line a-a'.
Figure 3C:
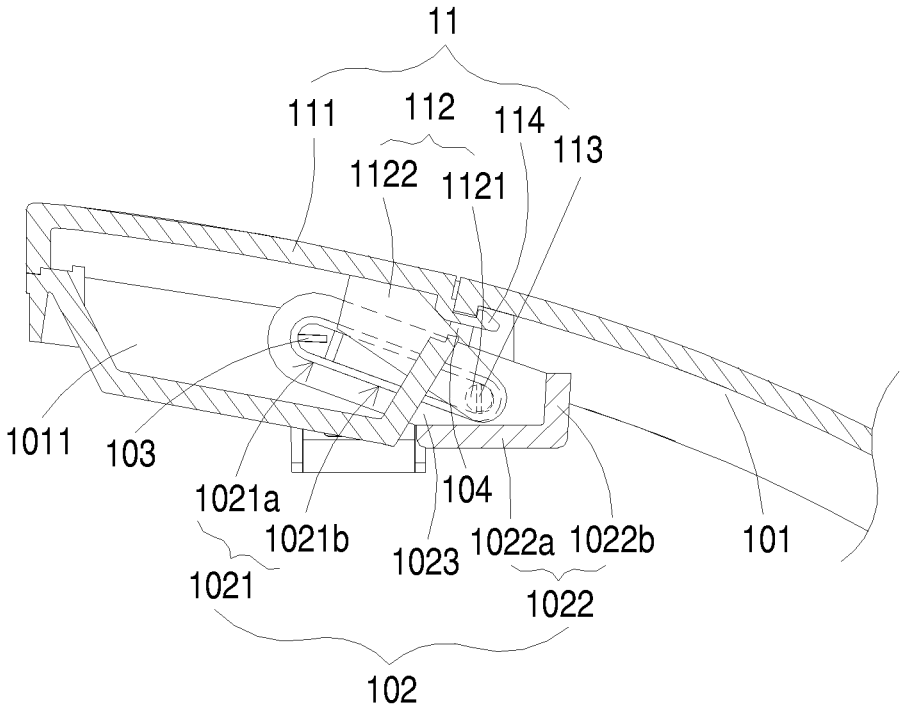
FIG. 3C is a schematic cross-sectional view illustrating the engagement between the lid plate of the lid member and the main body of the covering member.

FIG. 3A is a schematic perspective view illustrating the case structure of FIG. 1, in which the lid member is closed with respect to the covering member. FIG. 3B is a schematic cross-sectional view illustrating the case structure of FIG. 3A and taken along the line a-a'. FIG. 3C is a schematic cross-sectional view illustrating the engagement between the lid plate of the lid member and the main body of the covering member.

As shown in FIGS. 3A and 3B, when the lid plate 111 of the lid member 11 is rotated with respect to the main body 101 of the covering member 10 to the second position, the operating space 1011 of the main body 101 is shielded by the lid plate 111. Due to the engagement between the fourth positioning part 114 (e.g. the hooking element) of the lid member 11 and the third positioning part 104 (e.g. the fastening slot) of the covering member 10, the lid plate 111 is fixed on the main body 101 after the lid plate 111 is rotated to the second position (see FIG. 3C). Since the operating space 1011 is sealed by the lid plate 111, the foreign matter (e.g. dust, moisture, or the like) is prevented from entering the operating space 1011. Meanwhile, the protruding block 1121 of the second coupling part 112 is accommodated within the second segment 1021*b* of the guiding track 1021 and distant from the first segment 1021*a*.

By applying a tiny force on the lid plate 111 to push the lid plate 111 in the direction distant from the main body 101, the fourth positioning part 114 is disengaged from the third positioning part 104 because of the material property of the third positioning part 104. After the fourth positioning part 114 is disengaged from the third positioning part 104, the lid plate 111 may be uplifted. Meanwhile, the protruding block 1121 is guided by the second segment 1021*b* of the guiding track 1021 so that the lid plate 111 is rotated with respect to the main body 101 to expose the operating space 1011. Since the height H of the protruding block 1121 is slightly greater than or equal to the depth d1 of the first segment 1021*a* of the guiding track 1021, after the protruding block 1121 is moved from the second segment 1021*b* to the first segment 1021*a*, the protruding block 1121 and the second positioning part 113 are interfered by the first segment 1021*a* to slightly suppress and deform the second extension element 1122. Until the lid plate 111 is rotated with respect to the main body 101 to the first position (see FIG. 1), the second positioning part 113 is substantially aligned with the first positioning part 103 and accommodated within the first positioning part 103. Meanwhile, the protruding block 1121 is no longer interfered by the first segment 1021*a*, and the second extension element 1122 is no longer suppressed. Due to the restoring force of the second extension element 1122, the protruding block 1121 is sustained against the first segment 1021*a* of the guiding track 1021. Since the second positioning part 113 is interference-fitted into the first positioning part 103, the lid plate 111 is positioned with respect to the main body 101 and the operating space 1011 is kept at the open status. Meanwhile, through the operating space 1011, the user may replace the lamp of the optical engine 2, adjust the component of the optical engine 2 or adjust the focal length of the optical engine 2 (see FIG. 1). When the lid 111 is rotated to the first position, the angle between the lid plate 111 and the main body 101 is approximately 90 degrees (e.g. 93 degrees). Since the guiding track 1021 is an inclined track, the abrasion between the lid plate 111 and the main body 101 is minimized during the lid plate 111 is rotated with the main body 101.

Due to the engagement between the fourth positioning part 114 of the lid member 11 and the third positioning part 104 of the covering member 10, the lid plate 111 is fixed on the main body 101 after the lid plate 111 is rotated to the second position. As such, the operating space 1011 is sealed by the lid plate 111.

From the above description, when the lid 111 is rotated with respect to the main body 101 to the first position to expose the operating space 1011, the second positioning part 113 is interference-fitted into the first positioning part 103 and thus the lid 111 is positioned with respect to the main body 101. In this situation, the possibility of hurting the user by the lid plate is minimized.

Figure 4A:
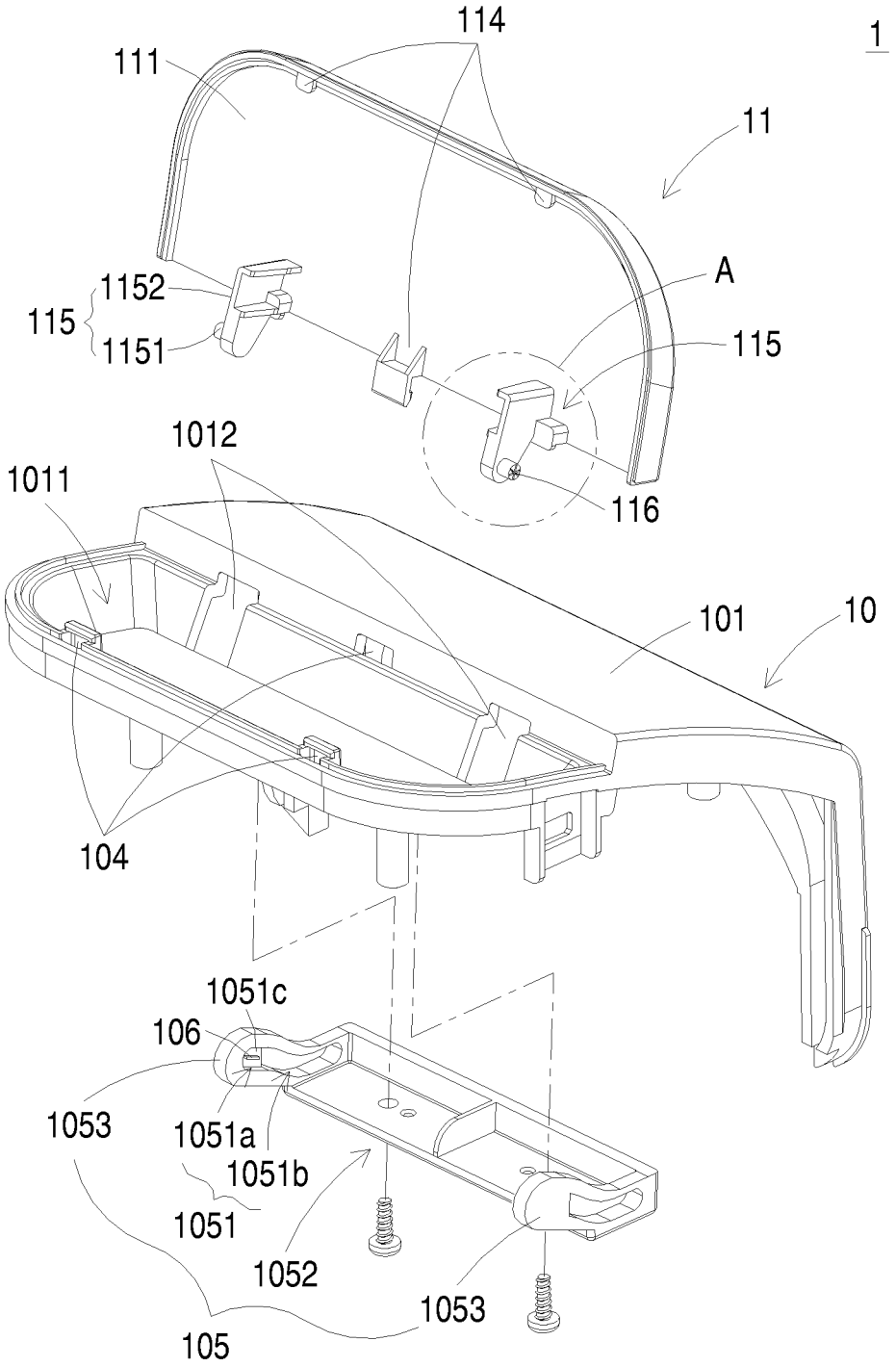
FIG. 4A is a schematic exploded view illustrating a portion of a case structure according to another embodiment of the present invention.

FIG. 4A is a schematic exploded view illustrating a portion of a case structure according to another embodiment of the present invention. For clarification, some components of the covering member are not shown in the drawings. In this embodiment, the case structure 1 comprises a covering member 10 and a lid member 11. The covering member 10 comprises a main body 101, a first coupling part 105 and a first positioning part 106.

Please refer to FIG. 4A again. In this embodiment, the first coupling part 105 comprises at least one guiding track 1051, a connecting element 1052 and at least one first extension element 1053. Similarly, the connecting element 1052 comprises a base plate and a side plate. In this embodiment, the first coupling part 105 has two first extension elements 1053. These two first extension elements 1053 are arranged at two opposite terminals of the connecting element 1052. Moreover, the first extension elements 1053 are S-shaped. In this embodiment, the first coupling part 105 has two guiding tracks 1051. The guiding tracks 1051 are disposed in respective first extension elements 1053, and face the connecting element 1052. The guiding track 1051 is an S-shaped track with the same width. The guiding track 1051 of the first coupling part 152 comprises a first segment 1051*a* and a second segment 1051*b*. The second segment 1051*b* is closer to the connecting element 1052 than the first segment 1051*a*. The second segment 1051*b* is an elongated opening running through the extension element 1053. The first segment 1051*a* comprises a baffle plate 1051*c* so that the depth of the first segment 1051*a* is smaller than the depth of the second segment 1051*b*. Since the guiding track 1051 is an S-shaped track, the first segment 1051*a* is higher than the second segment 1051*b*. The first positioning part 106 of the covering member 10 is a protrusion (e.g. a linear protrusion), which is formed on the first segment 1051*a* of the guiding track 1051.

Figure 4B:
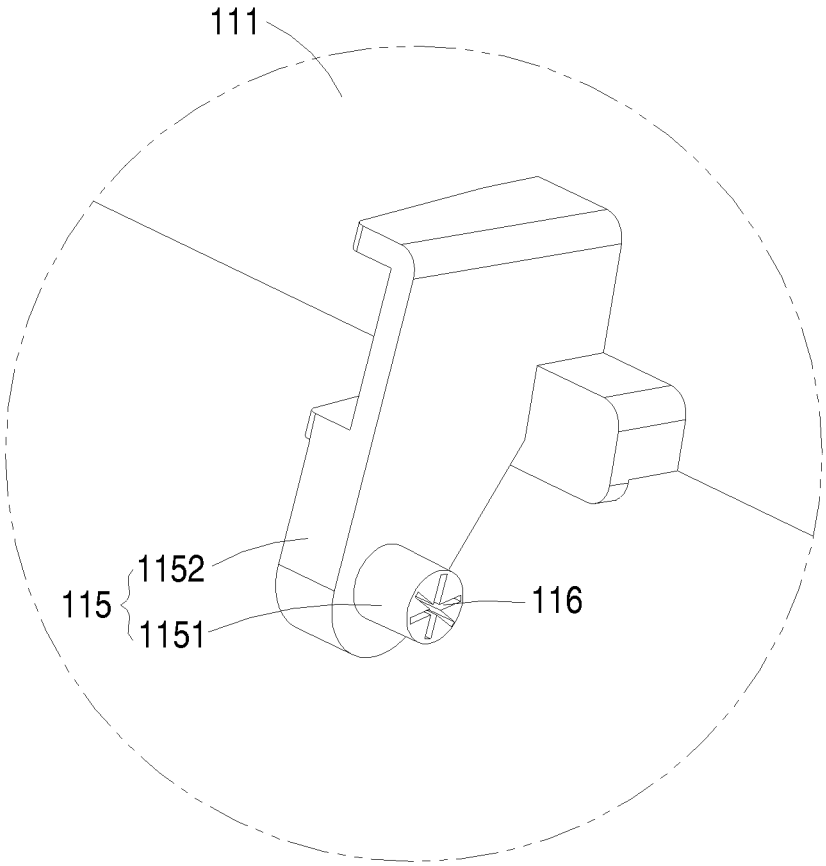
FIG. 4B is a schematic perspective view illustrating the portion A of FIG. 4A.

The lid member 11 comprises a lid plate 111, a second coupling part 115 and a second positioning part 116. The second coupling part 115 comprises a protruding block 1151 and a second extension element 1152. The second extension element 1152 is disposed on a surface of the lid plate 151 and extended from an edge of the lid plate 111. The protruding block 1151 is disposed on the second extension element 1152. The second positioning part 116 of the lid member 11 is disposed on the protruding block 1151. The dimension and shape of the second positioning part 116 mate with the first positioning part 106 of the covering member 10. Since the first positioning part 106 of the covering member 10 is a linear protrusion, the second positioning part 116 of the lid member 11 is an asterisk slot (see FIG. 4B).

The engagement between the first coupling part 105 of the covering member 10 and the second coupling part 115 of the lid member 11 is similar to the first embodiment, and is not redundantly described herein. That is, due to engagement between the guiding track 1051 and the protruding block 1151, the lid member 11 is securely fixed on the covering member 10. When the lid plate 111 is rotated to a first position, the second positioning part 116 is interference-fitted into the first positioning part 106 so that the lid plate 111 is positioned with respect to the main body 101. Since the lid plate 111 is opened to expose the operating space 1011, the user may replace the lamp of the optical engine 2, adjust the component of the optical engine 2 or adjust the focal length of the optical engine 2 (see also FIG. 1). In this embodiment, the second positioning part 116 of the lid member 11 is an asterisk slot so that the lid plate 111 may fixed at different positions with respect to the main body 101 in a multi-stage manner. When the lid plate 111 of the lid member 11 is rotated with respect to the main body 101 of the covering member 10 to the second position, the operating space 1011 of the main body 101 is shielded by the lid plate 111.

In this embodiment, the covering member 10 comprises at least one third positioning part 104 (e.g. a fastening slot) and the lid member 11 comprises a fourth positioning part 114 (e.g. a hooking element). Due to the engagement between the fourth positioning part 114 of the lid member 11 and the third positioning part 104 of the covering member 10, the lid plate 111 is fixed on the main body 101 after the lid plate 111 is rotated to the second position.

In the above embodiments, the third positioning part 104 is a fastening slot, and the fourth positioning part 114 is a hooking element. In some embodiments, the third positioning part 104 is a hooking element, and the fourth positioning part 114 is a fastening slot. Moreover, as shown in FIGS. 2A and 4A, the first positioning part of the covering member and the second positioning part of the lid member may be exchanged. As shown in FIG. 2A, the first positioning part is a fastening slot, and the second positioning part is a protrusion. Whereas, as shown in FIG. 4A, the first positioning part is a protrusion, and the second positioning part is fastening slot. The first positioning part and the second positioning part are not restricted to the above structures as long as they are interference-fitted into with each other.

Moreover, since the first coupling part is detachable from the main body, the first coupling part may be replaced with a new one if the first coupling part is damaged. The first coupling part may be integrally formed with the main body. Alternatively, the guiding track of the first coupling part may be directly extended from the sidewall of the operating space while adjusting the location of the second coupling part. In the above embodiments, the optical engine is partially shielded by the case structure. In a case that the optical engine is very small, the optical engine may be directly accommodated within the case structure.

It is noted that, however, those skilled in the art will readily observe that numerous modifications and alterations may be made while retaining the teachings of the invention. For example, the angle between the lid plate and the main body is not limited to 90 degrees when the lid is rotated to the first position. In addition, the guiding track of the first coupling part may be replaced with a pivotal hole in order to be engaged with the protruding block of the second coupling part.

Moreover, when the lid plate is rotated to the first position, the second positioning part is interference-fitted into the first positioning part so that the lid plate is positioned with respect to the main body. In this situation, the possibility of hurting the user by the lid plate is minimized. Even if the optical device is hung on a wall or a ceiling, the case structure of the present invention may facilitate the user to open the lid plate in order to replace a lamp, adjust the component or adjust the focal length of the optical device.

Since the guiding track of the first coupling part is an incline track or an S-shaped track, the abrasion between the lid plate and the main body is minimized during the lid plate is rotated with the main body. In this situation, the lid member is more aesthetically pleasing. Moreover, due to the engagement between the fourth positioning part and the third positioning part, the lid plate is fixed on the main body after the lid plate is rotated to the second position. Since the operating space is sealed by the lid plate, the foreign matter (e.g. dust, moisture, or the like) is prevented from entering the operating space.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A case structure for an optical device comprising:

a covering member comprising a main boy, a first coupling part and a first positioning part; and a lid member comprising a lid plate, a second coupling part and a second positioning part, wherein said second coupling part of said lid member and said first coupling part of said covering member are engaged with each other so that said lid plate is coupled with said main body and pivotal with respect to said main body, wherein when said lid plate is rotated to a first position, said second positioning part is interference-fitted into said first positioning part so that said lid plate is positioned with respect to said main body.

2. The case structure for an optical device according to claim 1, wherein said main body of said covering member further comprises an operating space, wherein said lid plate is opened to expose said operating space when said lid plate is rotated to said first position, and said operating space is sheltered by said lid plate when said lid plate is rotated to a second position.

3. The case structure for an optical device according to claim 2, wherein said first coupling part of said covering member comprises a guiding track extended into said operating space, said second coupling part comprises a protruding block, and said protruding block is inserted in said guiding track so that said lid plate is positioned with respect to said main body.

4. The case structure for an optical device according to claim 3, wherein said guiding track of said first coupling part comprises a first segment and a second segment, wherein a depth of said first segment is substantially smaller than that of said second segment, and said first positioning part is disposed in said first segment.

5. The case structure for an optical device according to claim 4, wherein said guiding track is an inclined track or an S-shaped track, and said first segment is higher than said second segment.

6. The case structure for an optical device according to claim 4, wherein said main body of said covering member further comprises a perforation in communication with said operating space, and said first coupling part comprises:

a connecting element connected with said main body; and a first extension element extended from said connecting element and protruded into said operating space through said perforation, wherein said guiding track is disposed in said first extension element, and said second segment of said guiding track is closer to said connecting element than said first segment.

7. The case structure for an optical device according to claim 3, wherein said second positioning part of said lid member is disposed on said protruding block.

8. The case structure for an optical device according to claim 7, wherein said second coupling part of said lid member further comprises a second extension element, which is disposed on said lid plate and extended from an edge of said lid plate, wherein said protruding block is disposed on said second extension element.

9. The case structure for an optical device according to claim 2, wherein said covering member further comprises a third positioning part, which is disposed on said main body and in the vicinity of the periphery of said operating space, wherein said lid member further comprises a fourth positioning part, which is disposed on said lid plate and aligned with said third positioning part, wherein when said lid plate is rotated to said second position, said third positioning part is engaged with said fourth positioning part so that said lid plate is positioned on said main body.

10. The case structure for an optical device according to claim 9, wherein said third positioning part of said covering member includes a fastening slot and said fourth positioning part of said lid member includes a hooking element engaged with said fastening slot, or said third positioning part of said covering member includes a hooking element and said fourth positioning part of said lid member includes a fastening slot engaged with said hooking element.

11. The case structure for an optical device according to claim 1, wherein said first positioning part of said covering member is a protrusion and said second positioning part of said lid member is a fastening slot, or said first positioning part of said covering member is a fastening slot and said second positioning part of said lid member is a protrusion.

12. An optical device comprising:

an optical engine; and a case structure partially shielding said optical engine, and comprising:

a covering member comprising a main boy, a first coupling part and a first positioning part; and a lid member comprising a lid plate, a second coupling part and a second positioning part, wherein said second coupling part of said lid member and said first coupling part of said covering member are engaged with each other so that said lid plate is coupled with said main body and pivotal with respect to said main body, wherein when said lid plate is rotated to a first position, said second positioning part is interference-fitted into said first positioning part so that said lid plate is positioned with respect to said main body.

13. The optical device according to claim 12, wherein said main body of said covering member further comprises an operating space, wherein said lid plate is opened to expose said operating space when said lid plate is rotated to said first position, and said operating space is sheltered by said lid plate when said lid plate is rotated to a second position.

14. The optical device according to claim 13, wherein said first coupling part of said covering member comprises a guiding track extended into said operating space, said second coupling part comprises a protruding block, and said protruding block is inserted in said guiding track so that said lid plate is positioned with respect to said main body.

15. The optical device according to claim 14, wherein said guiding track is an inclined track or an S-shaped track, said guiding track comprises a first segment and a second segment, said first segment is higher than said second segment, a depth of said first segment is substantially smaller than that of said second segment, and said first positioning part is disposed in said first segment.

16. The optical device according to claim 15, wherein said main body of said covering member further comprises a perforation in communication with said operating space, and said first coupling part comprises:

a connecting element connected with said main body; and a first extension element extended from said connecting element and protruded into said operating space through said perforation, wherein said guiding track is disposed in said first extension element, and said second segment of said guiding track is closer to said connecting element than said first segment.

17. The optical device according to claim 14, wherein said second positioning part of said lid member is disposed on said protruding block.

18. The optical device according to claim 17, wherein said second coupling part of said lid member further comprises a second extension element, which is disposed on said lid plate and extended from an edge of said lid plate, wherein said protruding block is disposed on said second extension element.

19. The optical device according to claim 13, wherein said covering member further comprises a third positioning part, which is disposed in said main body and in the vicinity of the periphery of said operating space, wherein said lid member further comprises a fourth positioning part, which is disposed on said lid plate and aligned with said third positioning part, wherein when said lid plate is rotated to said second position, said third positioning part is engaged with said fourth positioning part so that said lid plate is positioned on said main body.

20. The optical device according to claim 12, wherein said optical device is a projector.

* * * * *